United States Patent [19]

Nakata et al.

[11] 4,115,893

[45] Sep. 26, 1978

[54] GUM BRUSH FOR INFANTS

[75] Inventors: Yuichi Nakata, Chigasaki; Tadayoshi Murakami, Tokyo, both of Japan

[73] Assignee: Pigeon Kabushiki Kaisha, Tokyo, Japan

[21] Appl. No.: 793,803

[22] Filed: May 4, 1977

[30] Foreign Application Priority Data

Jul. 7, 1976 [JP] Japan ..... 51-89907

[51] Int. Cl.[2] ..... A46B 9/04

[52] U.S. Cl. ..... 15/110; 15/167 R; 15/210 R; 128/62 A

[58] Field of Search ..... 15/110, 167 R, 210 R; 128/62 A

[56] References Cited

U.S. PATENT DOCUMENTS

| | | | |
|---|---|---|---|
| 726,727 | 4/1903 | Mills | 128/62 A UX |
| 1,212,147 | 3/1917 | Picard | 15/167 R X |
| 1,248,675 | 12/1917 | Kowinsky | 15/167 R X |
| 1,382,587 | 6/1921 | Withycombe | 15/210 R |
| 2,103,083 | 12/1937 | Lynch | 128/62 A UX |
| 2,134,934 | 11/1938 | Wilhoit | 128/62 A X |
| 2,209,173 | 7/1940 | Russell | 15/167 R |
| 2,244,699 | 6/1941 | Hosey | 15/167 R X |
| 2,545,814 | 3/1951 | Kempster | 15/167 R X |
| 2,667,655 | 2/1954 | Halford, Jr. | 15/210 R X |
| 3,231,925 | 2/1966 | Conder | 15/110 X |

FOREIGN PATENT DOCUMENTS

| | | | |
|---|---|---|---|
| 1,095,847 | 12/1954 | France | 128/62 A |
| 2,410,175 | 9/1975 | Fed. Rep. of Germany | 128/62 A |
| 130,995 | 3/1929 | Switzerland | 128/62 A |
| 297,994 | 10/1928 | United Kingdom | 128/62 A |

*Primary Examiner*—Stanley N. Gilreath
*Attorney, Agent, or Firm*—Ladas, Parry, Von Gehr, Goldsmith & Deschamps

[57] ABSTRACT

A gum brush has an elongated handle with a stem end, to which is secured a brush head having a bullet shape and provided therearound in symmetrically distributed arrangement several fin-like projections some of which are parallel to the handle and others are perpendicular to the handle, these projections and the brush head being made of a rubberlike material such as cis-1,4-polyisoprene. In use, the brush head and projections are placed in an infant's mouth and moved at random or are chewed by the infant. As a result, the infant's teeth are cleaned, and, at the same time, its gums are firmed and strengthened.

3 Claims, 21 Drawing Figures

GUM BRUSH FOR INFANTS

BACKGROUND OF THE INVENTION

This invention relates generally to implements for oral hygiene such as toothbrushes and gum massagers and more particularly to a gum brush suitable for use principally by infants from the time when they start teething to the time when their milk (deciduous) teeth have become fully grown.

The teeth of infants are milk teeth of immature structure and readily become carious or decayed unless they are cared for especially well. However, infants are of ages at which it is difficult for them to carry out thorough cleaning of their teeth, and even when they are compelled to brush their teeth with conventional imbedded-bristle toothbrushes of small size, this care is not sufficient for preventing caries.

On one hand, as so-called civilization progresses, and the dietary standards improve, the frequency with which infants consume foods and drinks tending to promote tooth decay increases. For this reason, cases of dental caries in infants have been rapidly increasing in recent years in comparison with other discases and are becoming a serious health problem.

SUMMARY OF THE INVENTION

It is an object of this invention to provide a gum brush which is optimally suited for use by infants who cannot use imbedded-bristle toothbrushes and is particularly effective in firming of the gums, which care is important during this period of growth of the infants.

Another object of the invention is to provide a gum brush having a plurality of soft projections in combinations such that, when the head of the gum brush is placed in an infant's mouth and moved arbitrarily, at least one of the projections rubs against each tooth to clean the outer surface thereof, and, at the same time, the gums are massaged.

Still another object of the invention is to provide a gum brush having a brush head of a structure having the soft projections and a relatively hard core, whereby when an infant chews on the brush head, the brush head functions to firm and strengthen the infant's gums.

A further object of the invention is to provide a gum brush for infants of a structure such that it can be easily cleaned after use.

According to this invention, briefly summarized, there is provided a gum brush for infants comprising an elongated handle with a forward stem end, a brush head made of a rubberlike material and secured onto the stem end, and a plurality of projections made of a rubberlike material and integrally joined to and projecting outward from the outer surface of the brush head.

The nature, utility, and further features of this invention will be more clearly apparent from the following detailed description with respect to preferred embodiments of the invention when read in conjunction with the accompanying drawings briefly described below, throughout which like parts are designated by like reference numerals.

DETAILED DESCRIPTION

Figure 1:
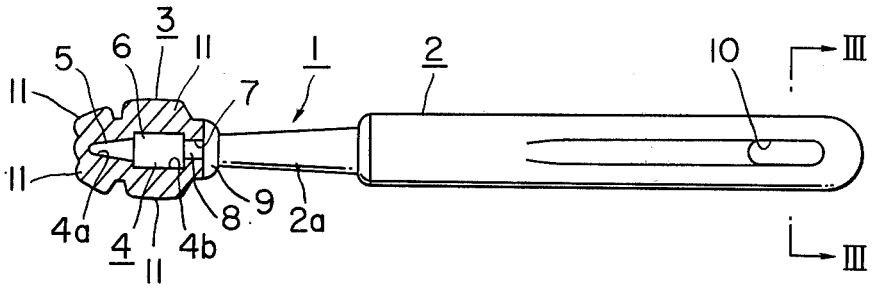
FIG. 1 is a side view of one example of a gum brush according to this invention, the brush head being shown in longitudinal section.
Figure 2:
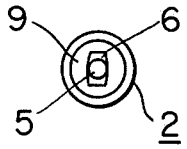
FIG. 2 is a front end view of the handle of this gum brush without the brush head.
Figure 3:
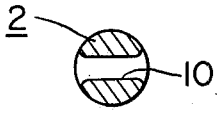
FIG. 3 is a cross section taken along the plane indicated by line III—III in FIG. 1 as viewed in the arrow direction.
Figure 4:
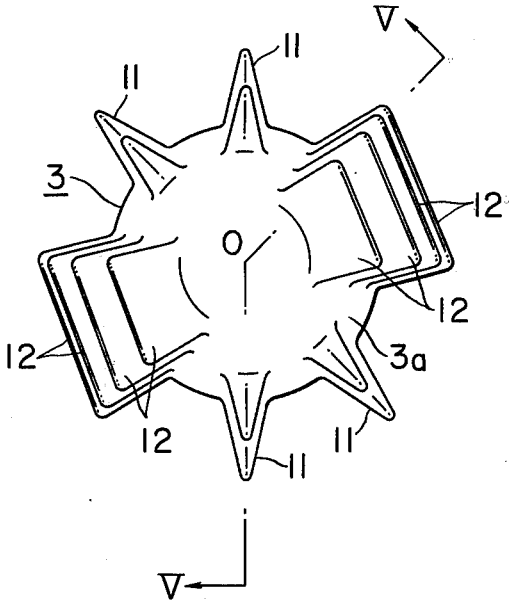
FIG. 4 is an enlarged front end view of the brush head.
Figure 5:
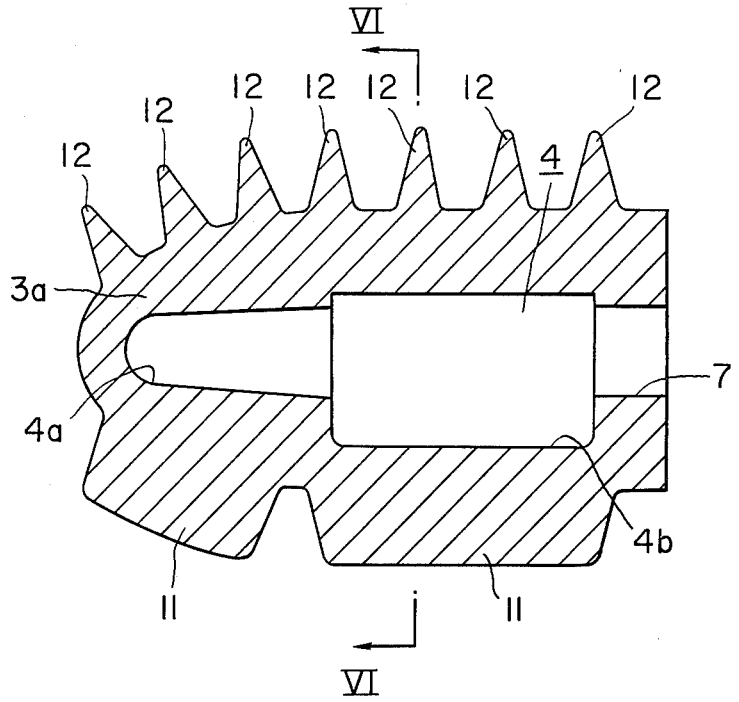
FIG. 5 is a section taken along the planes indicated by line V—O—V in FIG. 4 as viewed in the arrow direction.
Figure 6:
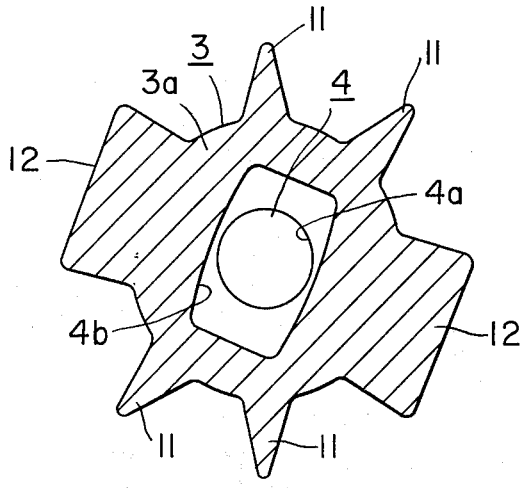
FIG. 6 is a cross section taken along the plane indicated by line VI—VI in FIG. 5 as viewed in the arrow direction.

As shown in FIG. 1, the gum brush 1 of this invention comprises a handle 2 having an integral stem part 2*a* extending forward and a brush head 3 fitted in locked state on the forward end of the stem part 2*a*. The handle 2 is made of a rigid resin such as an acrylonitrile-styrene copolymer, while the brush head 3 shown in enlarged view in FIGS. 4, 5, and 6 is made of a natural-rubber-like synthetic rubber such as cis-1,4-polyisoprene.

The brush head 3 comprises a head body 3*a* of the shape of a pistol bullet and projections projecting radially outward therefrom as described hereinafter. The head body 3*a* is provided therewithin with a cavity 4 having an innermost forward part 4*a* with a closed forward end, a non-round part 4*b* contiguously communicating with and positioned rearward from the forward part 4*a*, and an opening 7 of relative smaller diameter disposed to the rear of the non-round part 4*b*. The stem part 2*a* of the handle 2 is provided at its forward end, in sequence from the extreme tip rearward, a tip part 5 adapted to fit into the forward part 4*a* of the cavity 4, a stem head 6 for fitting in locked state into the non-round part 4*a* of the cavity, a neck part 8 for fitting tightly into the opening 7, and a flange 9 against which the rear end surface of the brush head 3 abuts. The handle 2 is provided near its rear end with a slot 10 for passing therethrough a string or ribbon or a hook for hanging the brush.

The brush head 3 and the handle 2 are coaxially aligned on a common centerline. The head body 3*a* of the brush head 3 has a plurality of fin-like projections formed integrally therewith and projecting radially outward therefrom. In the example illustrated in FIGS. 1 through 6, four tandem pairs of longitudinal projections 11 parallel to the centerline are provided in symmetrical, angularly spaced-apart arrangement as shown, two tandem pairs being relatively close together and positioned diametrically and symmetrically opposite the other two tandem pairs.

Between these oppositely disposed tandem pairs of longitudinal projections 11, two diametrically opposed groups of spaced-apart transverse projections 12 aligned in directions intersecting the centerline (perpendicular to the centerline in the illustrated example) are provided as shown, each group consisting of seven projections 12. Each pair of longitudinal projections 11 and each group of transverse projections 12 extend longitudinally over substantially the entire length of the head body 3*a* of the brush head 3. Thus, a total of 22 fin-like projections 11 and 12 are provided on the head body 3*a*.

Because of its construction as described above, the gum brush according to this invention is highly effective in that, when the brush head 3 is placed in an infant's mouth and moved in any arbitrary direction, at least one of the projections 11 and 12 rubs against each tooth to clean the outer surface thereof, and, at the same time, massaging of the gums is accomplished. Furthermore, when the infant chews on the brush head 3 with his gums, the brush head 3 which is in a structural state of having a hard core in its interior, functions to have the effect of firming and strengthening the gums.

In addition to these highly desirable features of operation in cleaning the teeth and massaging and developing the gums, the simple construction of the gum brush according to this invention affords easy cleaning of the brush after use, which feature is desirable for sanitary reasons.

It will be apparent that the projections such as 11 and 12 can be provided on the head body 3*a* in an almost infinite number of combinations of geometric shapes and arrangements. Some of the basic and preferred combinations, in addition to the example described above in detail, are illustrated in FIGS. 7A through 11D.

Figure 7A:
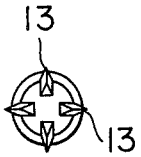
FIG. 7(A) is a front end view of a second gum brush according to this invention.
Figure 7B:
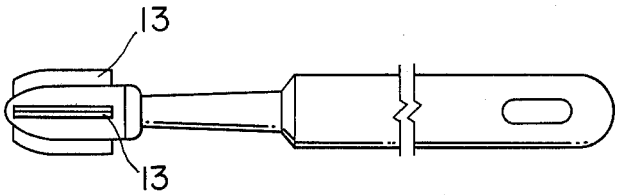
FIG. 7(B) is a side view of the second gum brush.
Figure 8A:
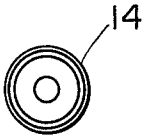
FIG. 8(A) is a front end view of a third gum brush according to this invention.
Figure 8B:
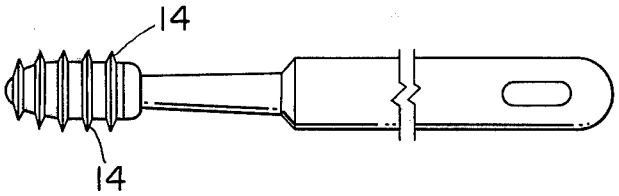
FIG. 8(B) is a side view of the third gum brush.

A basic design of the brush head wherein four longitudinal fin-like projections 13 are provided with equal angular spacing is shown in FIGS. 7(A) and 7(B). Another basic design of the brush head wherein five transverse fin-like projections 14 are provided in annular spaced-apart form is shown in FIGS. 8(A) and 8(B).

Figure 9A:
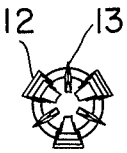
FIG. 9(A) is a front end view of a fourth gum brush according to this invention.
Figure 9B:
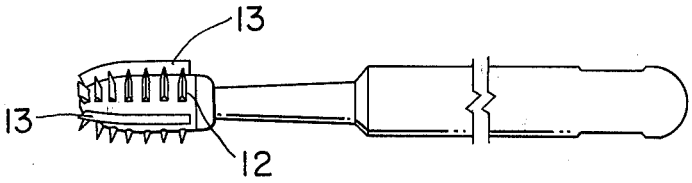
FIG. 9(B) is a side view of the fourth gum brush.
Figure 9:
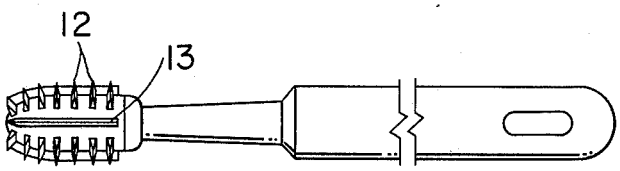
FIG. 9(C) is a further side view of the fourth gum brush, with the brush rotated through 90° from the position illustrated in FIG. 9(B)
Figure 10A:
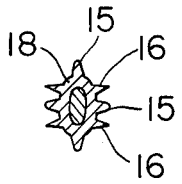
FIG. 10(A) is a cross section a fifth gum brush according to this invention, taken along the plane indicated by line XA—XA in FIG. 10(B) as viewed in the arrow direction.
Figure 10B:
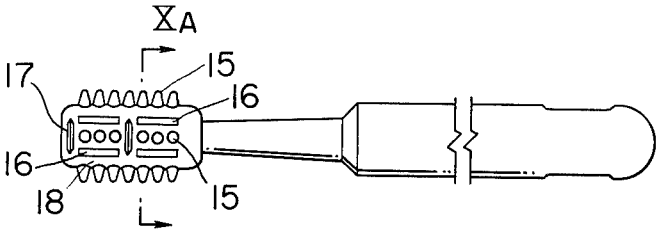
FIG. 10(B) is a side view of the fifth gum brush.
Figure 10C:
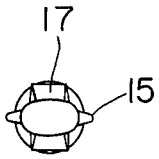
FIG. 10(C) is a front end view of the fifth gum brush.
Figure 10D:
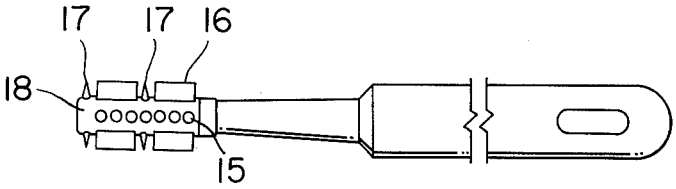
FIG. 10(D) is a further side view of the fifth gum brush, with the brush rotated through 90° from the posiiton illustrated in FIG. 10(B)
Figure 11A:
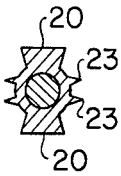
FIG. 11(A) is a cross section of a sixth gum brush according to this invention, taken along the plane indicated by line XIA—XIA in FIG. 11(B) as viewed in the arrow direction.
Figure 11B:
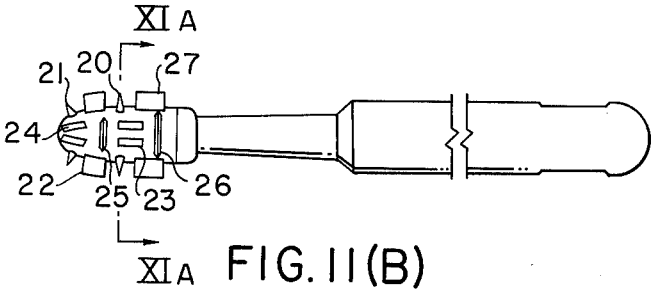
FIG. 11(B) is a side view of the sixth gum brush.
Figure 11C:
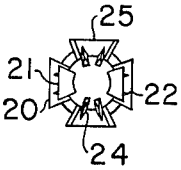
FIG. 11(C) is a front end view of the sixth gum brush.
Figure 11D:
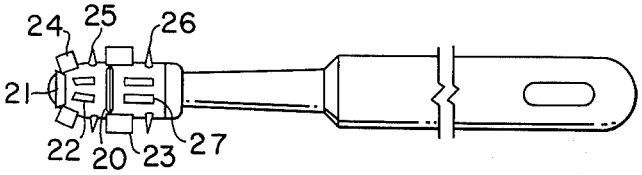
FIG. 11(D) is a further side view of the sixth gum brush, with the brush rotated through 90° from the position illustrated in FIG. 11(B).

In the example shown in FIGS. 9(A), 9(B), and 9(C), three longitudinal fins 13 are interposed alternately between three rows of transverse fins 12.

The example illustrated in FIGS. 10A–10D differs from the other examples in that the cross section of the head body 18 is not circular but is elliptical and in that finger-like projections 15 of substantially circular cross section are interspersed in longitudinal rows between fin-like projections 16 and 17.

A further example of a combination of longitudinal and transverse fin-like projections each of relatively short length is shown in FIGS. 11A–11D.

In FIGS. 11A–11D the cross-section of the head body 19 is circular. The transverse projections 20, 21, 25 and 26 are arranged in pairs, with the members of each pair being diametrically opposite each other. The longitudinal projections 22, 23, 24 and 27 are arranged in sets of four, with each set of four projections being made up of two diametrically opposed pairs. The longitudinal projections 22 are disposed between the transverse projections 20 and 21, while the longitudinal projections 23 are disposed between the transverse projections 25 and 26. The transverse projections 25 extend in the space between the longitudinal projections 23 and 24, while the transverse projections 20 extend in the space between the longitudinal projections 20 and 27.

We claim:

1. A gum brush for infants comprising an elongated handle with a forward stem end, a brush head made of a rubberlike material and secured onto said stem end, and a plurality of projections made of a rubber-like material and integrally joined to and projecting outward from the outer surface of said brush head, said projecting comprising first fin-like projections and second fin-like projections aligned in directions intersecting the directions of said first fin-like projections, all projections projecting radially outward from said brush head, and said first and second fin-like projections being mutually interspersed in symmetrical and distributed arrangement around the surface of the brush head.

2. A gum brush for infants comprising an elongated handle with a forward stem end, a brush head made of a rubberlike material and secured onto said stem end, and a plurality of projections made of a rubber-like material and integrally joined to and projecting outward from the outer surface of said brush head, said projections comprising first fin-like projections and second fin-like projections aligned in directions intersecting the directions of said first fin-like projections, all projections projecting radially outward from said brush head, said first fin-like projections being substantially parallel to the longitudinal direction of the elongated handle, and said second fin-like projections being substantially perpendicular to said longitudinal direction, eight of said first fin-like projections being provided in first, second, third, and fourth pairs each comprising two projections aligned in tandem in the longitudinal direction, said first and second pairs being relatively close to each other and respectively lying on the diametrically opposite sides of the brush head from said third and fourth pairs in symmetrical arrangement therewith, and fourteen of said second fin-like projections being provided in first and second groups each of seven projections disposed in spaced-apart positions along the longitudinal direction from the rear end to the forward end of the brush head, the first group being interposed between said second and third pairs and the second group being interposed between said first and fourth pairs in symmetrical arrangement.

3. A gum brush for infants comprising an elongated handle with a forward stem end, a brush head made of a rubberlike material and secured onto said stem end, and a plurality of projections made of a rubber-like material and integrally joined to and projecting outward from the outer surface of said brush head, and in which said projections comprise first fin-like projections, second fin-like projections aligned in directions intersecting the directions of said first fin-like projections, and a plurality of finger-like projections, all projections being disposed in mutually dispersed and symmetrically arranged groups.

* * * * *